US008490287B2

(12) United States Patent
Barter et al.

(10) Patent No.: US 8,490,287 B2
(45) Date of Patent: Jul. 23, 2013

(54) FENCE END SPACER APPARATUS AND METHOD FOR USE

(76) Inventors: Robert B. Barter, Lucedale, MS (US); Ruby G. Barter, Lucedale, MS (US)

( * ) Notice: Subject to any disclaimer, the term of this patent is extended or adjusted under 35 U.S.C. 154(b) by 0 days.

(21) Appl. No.: 13/066,068

(22) Filed: Apr. 6, 2011

(65) Prior Publication Data

US 2012/0030925 A1 Feb. 9, 2012

Related U.S. Application Data

(62) Division of application No. 11/900,587, filed on Sep. 12, 2007, now abandoned.

(51) Int. Cl.
*E04H 17/00* (2006.01)
*B23P 11/00* (2006.01)
*B21D 39/00* (2006.01)

(52) U.S. Cl.
USPC ..... 29/897.32; 29/525.02; 29/525.11; 29/525.14; 256/65.02; 256/65.03; 256/69

(58) Field of Classification Search
USPC ..... 256/65.02, 65.16, 68, 69, 22, 65.03; 29/525.01, 525.02, 525.11, 897.3, 897.32, 29/525.14
See application file for complete search history.

(56) References Cited

U.S. PATENT DOCUMENTS

| | | | | |
|---|---|---|---|---|
| 1,914,913 | A * | 6/1933 | Ferris | 256/22 |
| 3,589,682 | A * | 6/1971 | Dickey | 256/59 |
| 4,741,513 | A * | 5/1988 | Smith | 256/21 |
| 5,143,354 | A * | 9/1992 | Nolan | 256/12 |
| 5,421,557 | A * | 6/1995 | Vise | 256/24 |
| 5,531,427 | A * | 7/1996 | Quarles | 256/22 |
| 5,716,041 | A * | 2/1998 | Groves | 256/73 |
| 6,151,852 | A * | 11/2000 | Linn et al. | 52/239 |
| 6,279,879 | B1 * | 8/2001 | Statz | 256/65.1 |
| 6,345,809 | B1 * | 2/2002 | Bebendorf | 256/24 |
| 6,527,256 | B2 * | 3/2003 | Doyle, Jr. | 256/65.02 |
| 2010/0078613 | A1 * | 4/2010 | Payne | 256/24 |

* cited by examiner

*Primary Examiner* — Jermie Cozart

(57) ABSTRACT

A spacer apparatus of the invention is attached to a fence post to occupy a space between the fence post and a nearby structure. The subject fence end spacer apparatus includes space occupying members, and fence attachment members are connected to the space occupying members, for attaching the space occupying members to the fence post. The space occupying members fills the space between the fence post and a nearby structure. The space occupying members can include horizontal members connected to the fence attachment members and can include vertical members connected to the horizontal members. Together, the horizontal members and the vertical members provide a space-occupying fence portion. The fence attachment means can include first and second fence attachment members for contacting first and second portions of the fence post. The method of using the fence end spacer apparatus to removably fill the space between the fence post and the nearby structure.

3 Claims, 3 Drawing Sheets

FENCE END SPACER APPARATUS AND METHOD FOR USE

CROSS-REFERENCE TO RELATED APPLICATION

This application is a divisional application of our prior copending non-provisional application Ser. No. 11/900,587; filed Sep. 12, 2007 which is now abandoned.

BACKGROUND OF THE INVENTION

1. Field of the Invention

The present invention relates generally to devices affixed to fences and, more particularly, to a fence end spacer apparatus especially adapted for filling a spatial gap between an end fence post and a nearby structure.

2. Description of the Prior Art

A problem often associated with fences is the presence of a spatial gap between a fence and a nearby structure. More specifically, a fence post at the end of a fence, called herein an end fence post, to be securely secured in the ground, often has an underground post hole that contains a quantity of cement. The underground post hole generally has a radius that is considerably larger than the radius of the end fence post itself. As a result, although the underground post hole may abut or nearly abut the foundation of a nearby structure, the end fence post itself is separated from the nearby structure by at least the spatial difference between the radius of the underground post hole and the radius of the end fence post.

The spatial gap can also be exacerbated by foundation footings and other underground obstructions such as buried water, drain, or electrical lines.

The spatial gap can be problematical for a number of reasons. Small animals can pass through the spatial gap, thereby defeating the presence of the fence. Small children can pass through the spatial gap, thereby providing a dangerous situation when the fence is intended to keep children out from a dangerous location, such as a swimming pool. Aside from unwanted injury or death, unwanted lawsuits could result. In view of the above, the purpose of the present invention is to solve the problem of filling the spatial gap between an end fence post and a nearby structure.

Other features would be desired with a device that fills the spatial gap between an end fence post and a nearby structure. For example, when it would be desired to perform maintenance, such as painting or repairs, on the nearby structure, it would be desirable for a fence end spacer apparatus to be swung out of a gap-filling position to allow close access to the nearby structure.

Also, since a fence often has ornamental as well as functional characteristics, it would be desirable if a fence end spacer apparatus also had ornamental features.

As a matter of interest, each of the following U.S. patents discloses a respective innovation with respect to fences: U.S. Pat. Nos. 4,193,583, 4,862,833, 5,577,713, 6,126,146, and 6,241,217. Yet, none of these patents discloses means for filling a spatial gap between an end fence post and a nearby structure.

More specifically, U.S. Pat. No. 4,193,583 discloses an extension for a fence of the chain link type, the extension having an upper panel portion and having mounting leg portions extending downwardly therefrom and passing vertically through openings in the chain link fabric to secure the extension thereto, each leg portion having an abutment thereon to limit downward travel of a leg portion into the fabric and having detents especially shaped and located along the leg surfaces to cooperate with the wires of the fabric to resist upward withdrawal of the leg portion from the fabric, once installed.

U.S. Pat. No. 4,862,833 discloses an animal tether device having a plurality of upright post members embedded in the ground interconnected by at least one fence member with a rail member mounted on the post members a distance above the ground, such rail member having a carriage member movably contained therein with a leash member extending therefrom attached to the animal and fence extension members disposed at each end of said plurality of post members extending from beneath the level of the rail member and curving downward at an angle to the ground to prevent the animal from going around the end posts of the series of posts too sharply so as to prevent tangling of the leash pulling the carriage moving within the rail member.

U.S. Pat. No. 5,577,713 discloses an anchoring device for retrofitting a possibly rot weakened wood post consisting of a slanted metal stake welded to a vertical attachment plate; where the device is bolted via the plate to the base area of the post above the ground; while the method includes digging an offset footing hole, then setting the bottom half of the stake in the footing hole with poured concrete after plumbing the post, temporarily bracing it, and mounting the device on it.

U.S. Pat. No. 6,126,146 discloses fence planks mounted on a supporting existing chain link fence. Each plank uses two or more rear spaced tapered mounting blocks with predrilled center holes. After inserting the tapered portion of the mounting block into the space between links, the simulated wood planks are placed on the opposite or outside of the supporting chain link fence. Holes are then drilled through the mounting blocks into the in-place plank until visible from the plank's exposed outer front surface. Next, a screw is screwed through the plank's exposed hole into the mount block to hold the plank to the chain link support fence. Planks are held to existing fence poles by drilling and then screwing them directly into the pole without rear mounting blocks. An enlarged rear tapered mounting block portion engages the fence's links to retain the planks to the chain link fence. The plank's may be made of wood or a molded plastic material which simulates the appearance of wooden plank's in grain, shape and color.

U.S. Pat. No. 6,241,217 discloses a wire-fence gap-closer-gate fastener has a lever rod (1) that is pivotal vertically on a lever pivot (2) proximate a pivot end of the lever rod. The lever pivot is positioned proximate a lever end of a post-attachment member (3) that is attachable to a top portion of a fixed gate-latch post (4). Fence wiring (6) is extended from a loose gate-latch post (8) to a fixed gate-pivot post (7). For a gate-closed mode, the loose gate-latch post is attachable juxtaposed to the fixed gate-latch post by positioning a top portion of the loose gate-latch post in a top post loop (12) and a handle end (10) of the lever rod is lowered to a lever rest (13) that positions a gate-tightening anchor (9) on the lever rod lower than the lever pivot.

Thus, while the foregoing body of prior art indicates it to be well known to use attachments to fences, the prior art described above does not teach or suggest a fence end spacer apparatus which has the following combination of desirable features: (1) filling the spatial gap between an end fence post and a nearby structure; (2) can be swung out of a gap-filling position to allow close access to the nearby structure; and (3) can have ornamental features. The foregoing desired characteristics are provided by the unique fence end spacer apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a spacer apparatus which is attached to a fence post to occupy a space between the fence post and a nearby structure. The subject fence end spacer apparatus includes space occupying means, and fence attachment means are connected to the space occupying means, for attaching the space occupying means to the fence post. The space occupying means fills the space between the fence post and a nearby structure.

The space occupying means can include horizontal members connected to the fence attachment means and can include vertical members connected to the horizontal members. Together, the horizontal members and the vertical members provide a space-occupying fence portion.

The fence attachment means can include a first fence attachment member for contacting a first portion of the fence post. A second fence attachment member is provided for contacting a second portion of the fence post. The second fence attachment member is connected to the space occupying means, and securing means are connected to the first fence attachment member, for securing the fence post between the first fence attachment member and the second fence attachment member.

The first fence attachment member can be a U-bolt, and the second fence attachment member can be a plate which is connected to the space occupying means. The securing means can include nuts attached to threaded ends of the U-bolt.

The vertical members includes bottom ends which are distanced from the ground by a bottom clearance distance.
A decoration device attached to the space occupying means.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved fence end spacer apparatus which has all of the advantages of the prior art and none of the disadvantages.

It is another object of the present invention to provide a new and improved fence end spacer apparatus which may be easily and efficiently manufactured and marketed.

It is a further object of the present invention to provide a new and improved fence end spacer apparatus which is of durable and reliable construction.

An even further object of the present invention is to provide a new and improved fence end spacer apparatus which is susceptible of a low cost of manufacture with regard to both materials and labor, and which accordingly is then susceptible of low prices of sale to the consuming public, thereby making such fence end spacer apparatus available to the buying public.

Still yet a further object of the present invention is to provide a new and improved fence end spacer apparatus which filling the spatial gap between an end fence post and a nearby structure.

Still another object of the present invention is to provide a new and improved fence end spacer apparatus that can be swung out of a gap-filling position to allow close access to the nearby structure.

Yet another object of the present invention is to provide a new and improved fence end spacer apparatus which can have ornamental features.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
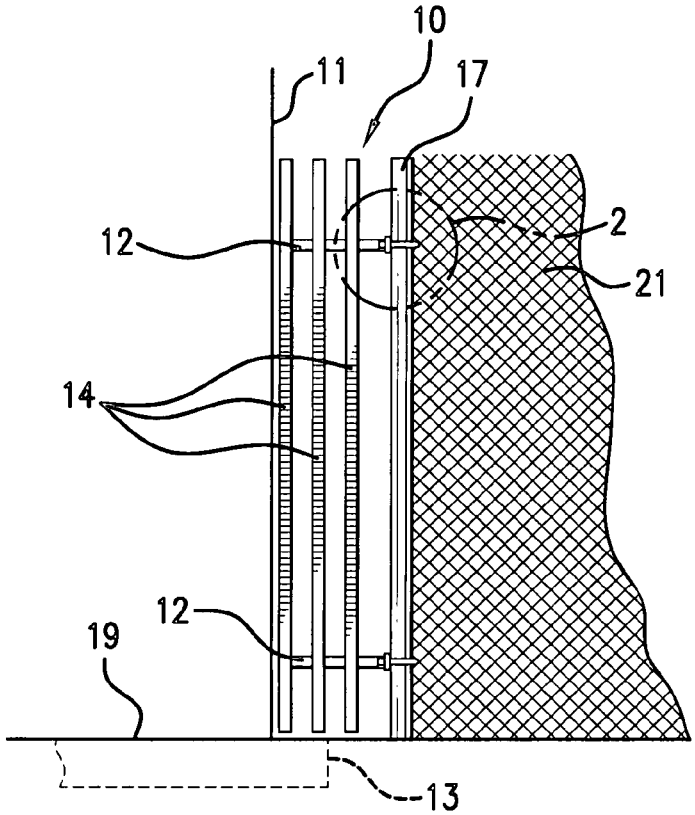
FIG. 1 is a side view showing a first embodiment of the fence end spacer apparatus of the invention, in use adjacent to a building that has a below-ground footer.
Figure 2:
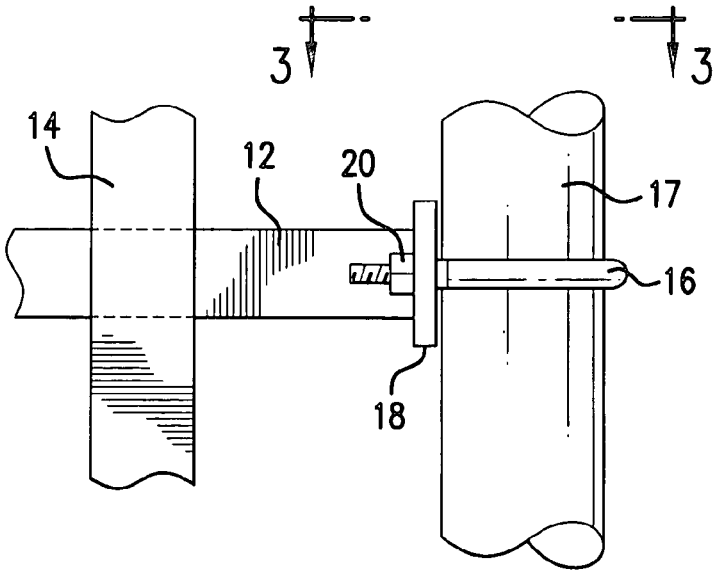
FIG. 2 is an enlarged view of the portion of the embodiment of the fence end spacer apparatus shown in FIG. 1 that is contained in circled region 2 of FIG. 1.
Figure 3:
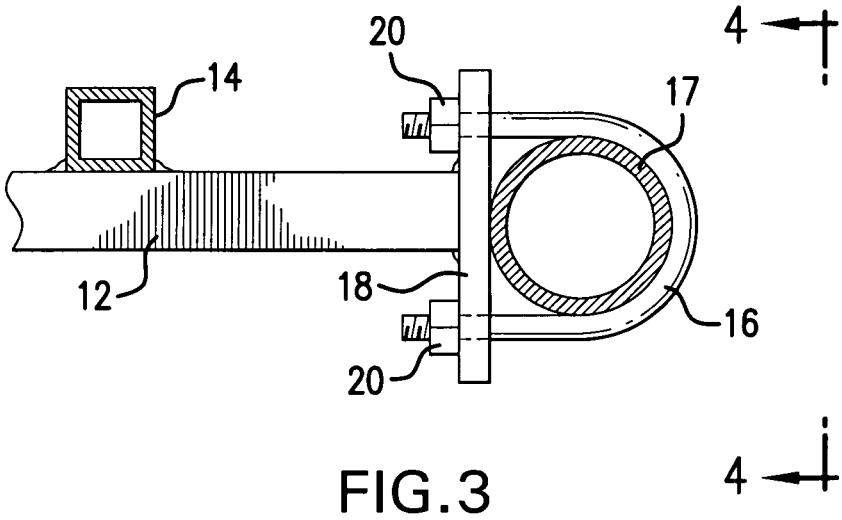
FIG. 3 is a top view of the portion of the embodiment of the fence end spacer apparatus of FIG. 2, taken along line 3-3 thereof.
Figure 4:
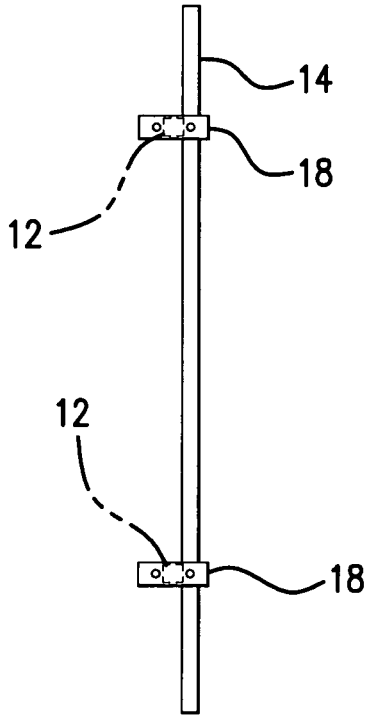
FIG. 4 is a reduced edge view of the embodiment of the invention shown in FIG. 3 taken along line 4-4 thereof.

With reference to the drawings, a new and improved fence end spacer apparatus embodying the principles and concepts of the present invention will be described.

Turning to FIGS. 1-4, there is shown a first embodiment of the fence end spacer apparatus of the invention generally designated by reference numeral 10. In each of the figures, reference numerals are shown that correspond to like reference numerals that designate like elements shown in other figures.

In the first embodiment, a spacer apparatus 10 of the invention is attached to a fence post 17 such as the end of a fence 21, to occupy a space between the fence post 17 and a nearby structure. The subject fence end spacer apparatus 10 includes space occupying means, and fence attachment means are connected to the space occupying means, for attaching the space occupying means to the fence post 17.

The space occupying means can include horizontal members 12 connected to the fence attachment means and can include vertical members 14 connected to the horizontal members 12. Together, the horizontal members 12 and the vertical members 14 provide a space-occupying fence portion.

The fence attachment means can include a first fence attachment member for contacting a first portion of the fence post 17. A second fence attachment member is provided for contacting a second portion of the fence post 17. The second fence attachment member is connected to the space occupying means, and securing means are connected to the first fence attachment member, for securing the fence post 17 between the first fence attachment member and the second fence attachment member.

The first fence attachment member can be a U-bolt 16, and the second fence attachment member can be a plate 18 which is connected to the space occupying means. The securing means can include nuts 20 attached to threaded ends of the U-bolt 16.

Each plate 18 is connected to a horizontal member 12 of the space occupying means. A plate 18 and a horizontal member 12 can be welded together to form a unified, integrated structure. In addition, each of the vertical members 14 can be welded to the horizontal members 12 so that the vertical members 14 and the horizontal members 12 form a unified, integrated structure which serves as a space-filling fence segment for the space occupying means. The vertical members 14 includes bottom ends 22 which are distanced from the ground 19 by a bottom clearance distance 24.

Figure 5:
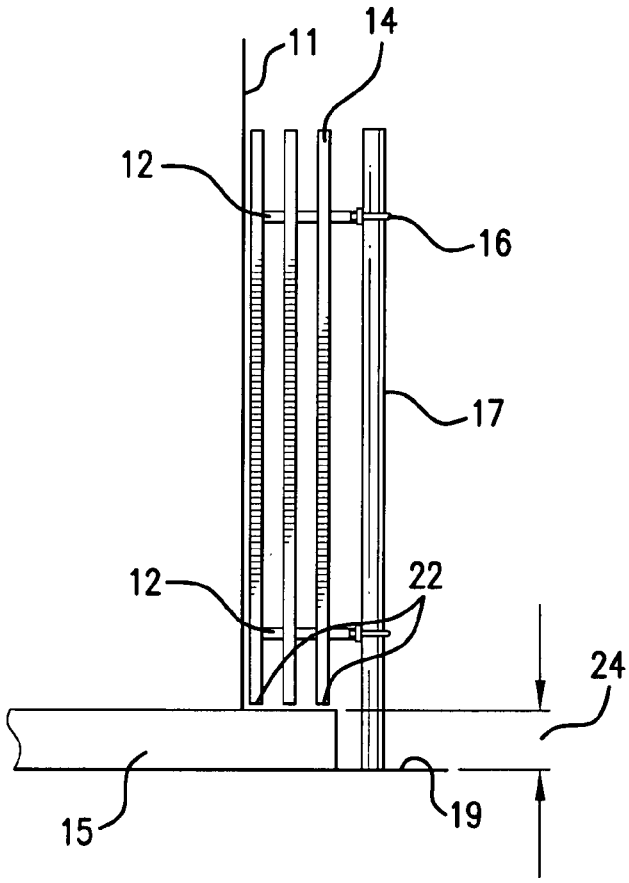
FIG. 5 is a side view showing a second embodiment of the fence end spacer apparatus of the invention, in use adjacent to a building that has an above-ground footer.

As shown in FIG. 5, with a second embodiment of the invention, the bottom clearance distance 24 of the bottom ends 22 of the vertical members 14 is greater than the height of the above-ground footer 15 of the building 11. In this way, the space-filling fence segment fills the space between the building 11 and the fence post 17 above the above-ground footer 15, and, at the same time does not have interference from the above-ground footer 15.

Figure 6:
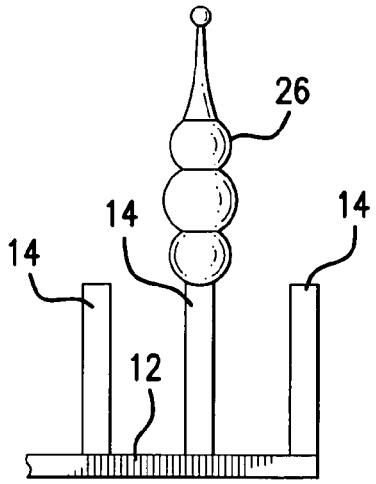
FIG. 6 is an enlarged side view of a top portion of the embodiment of the invention shown in FIG. 5, wherein a decoration is supported by the embodiment.

As shown in FIG. 6, decoration device 26 attached to the space occupying means. More specifically, the decoration device 26 can be attached to a top end of a vertical member 14.

To install an embodiment of the invention on a fence post 17, such as the end of a fence 21, a number of plates 18 are placed against respective outside portions of the fence post 17. Then. A corresponding number of U-bolts 16 are placed on respective inside portions of the fence post 17 so that respective ends of the U-bolts 16 pass through orifices in the plates 18. Then, nuts 20 are screwed onto the ends of the U-bolts 16. When the nuts 20 are tightened onto the U-bolts 16, the fence end spacer apparatus 10 of the invention is affixed to the fence post 17 to occupy the space between the fence post 17 and the building 11.

If desired, the space occupying means can be in a form that does not have the appearance of a fence. In this respect, the space occupying means can be in the form of a small wall or panel.

The fence end spacer apparatus 10 of the invention is a universal fence spacer unit. It is especially useful for solving space problems created by buildings 11 and above-ground footers 15.

Conventionally, above-ground footers 15 prevent the fence post 17 from being placed very close to a building 11 when the building 11 has an above-ground footer 15. As a result. A building-to-fence space gap results between the fence post 17 and the building 11 due to the presence of the above-ground footer 15. As a consequence of the building-to-fence space gap, the conventional fence 21 does not provide a secure fence structure. Ordinarily, owners of the building 11 had to solve this building-to-fence space gap problem themselves. Often, when inexperienced owners tried to solve the building-to-fence space gap problem, the attempted solution results in a nondecorative or unattractive result. Such a nondecorative or unattractive result may detract from the appearance of a newly installed fence and may detract from the value of the property.

Large building-to-fence space gaps caused by above-ground footers 15 leave the property unsecured and would enable small children or animals to enter or leave the property when not desired. The problem of the building-to-fence space gap, if left unsolved, could lead to lawsuits for a swimming pool accident and could lead to yard damage caused by unwanted animals. In addition, treasured pets may escape from the property. Clearly, the fence end spacer apparatus 10 of the invention solves these problems.

The fence end spacer apparatus 10 of the invention can be easily used in both right-to-left and left-to-right space gap environments. Moreover, the apparatus of the invention provides an aesthetically desirable solution to the building-to-fence space gap problem. More specifically, the apparatus of the invention can have the appearance of a fence, or it can have the appearance of a decorative panel.

The fence end spacer apparatus 10 of the invention can be fabricated from steel stock and welded for maximum strength. Also, it can be galvanized coated to provide long, durable service. A galvanized coating can match galvanized coatings often used with conventional chain link fences. In addition, the apparatus of the invention can be painted to match any ornamental fence product. In addition, decoration devices 26 can be added to match or complement any welded or ornamental products.

Generally, the components of the fence end spacer apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved fence end spacer apparatus that is low in cost, relatively simple in design and operation, and which may advantageously be used to fill the spatial gap between an end fence post and a nearby structure. With the invention, a fence end spacer apparatus is provided which can be swung out of a gap-filling position to allow close access to the nearby structure. With the invention, a fence end spacer apparatus is provided which can have ornamental features.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. The method of filling the spatial gap between a building structure and a nearby fence post comprising the steps of:

(a) providing a spatial gap filling structural member, said spatial gap filling structural member comprising: at least first and second horizontally extending members and at least first and second vertically extending members welded to said at least first and second horizontally extending members to form a unified integrated segment of said spatial gap filling structural member, said spatial gap filling structural member further comprising first and second fence post attachment members welded to said at least first and second horizontally extending members, respectively, each said fence post attachment members comprising a fastening plate connected to a corresponding horizontally extending member, a pair of orifices in said plate, a U-bolt adapted to fit said orifices and a pair of nuts adapted to fit said U-bolt;

(b) positioning said spatial gap structural member relative to said fence post by placing said fastening plates against said fence post with the bottom of said spatial gap structural member substantially filling said spatial gap and the bottoms of said vertically oriented members being raised a clearance distance above the ground, and (c) affixing said spatial gap filling member to said fence post when placed in the position of step (b) by inserting said U-bolts about said fence post and into the orifices of each fastener plate and then tightening said pairs of nuts such that said spatial gap structural member substantially fills said spatial gap to limit ingress and egress through said spatial gap.

2. The method of claim 1 comprising the additional step of loosening said U-bolts nuts to permit said segment to be swung out of its affixed position to permit close access to said building structure.

3. The method of claim 1 wherein said building has an above-ground footer and said step (b) includes the additional step of positioning said spatial gap filling structural member relative to said fence post such that said spatial gap structural member is raised a clearance distance above the ground sufficient to avoid interference with said above-ground footer.

* * * * *